United States Patent [19]

Lay

[11] Patent Number: 4,883,272

[45] Date of Patent: Nov. 28, 1989

[54] BALL CATCHING FRAME WITH BALL EXPELLING MACHINE CONNECTED THERETO

[76] Inventor: William C. Lay, 931 Creek Hill La., Midvale, Utah 84047

[21] Appl. No.: 189,103

[22] Filed: May 2, 1988

[51] Int. Cl.[4] ..... A63B 69/40

[52] U.S. Cl. ..... 273/26 A; 273/29 A; 273/181 F; 273/395; 273/410; 273/407; 273/26 D; 124/81; 124/6

[58] Field of Search ..... 273/29 A, 26 A, 29 B, 273/26 R, 29 R, 41 C, 26 D, 181 F, 1 R, 411, 392, 401, 407, 395, 396, 402; 124/78, 81

[56] References Cited

U.S. PATENT DOCUMENTS

| | | | |
|---|---|---|---|
| 2,805,070 | 9/1957 | Waters | 273/181 F |
| 2,895,737 | 7/1959 | Blees | 273/181 F |
| 3,711,092 | 1/1973 | Hogue | 273/26 A |
| 3,724,437 | 4/1973 | Halstead | 124/78 |
| 3,766,901 | 10/1973 | Cleary et al. | 273/26 D |
| 4,127,272 | 11/1978 | Pennell | 273/411 |
| 4,197,827 | 4/1980 | Smith | 124/78 |
| 4,531,504 | 7/1985 | Gilreath | 124/78 |
| 4,552,120 | 11/1985 | Nall et al. | 273/26 D |
| 4,643,423 | 2/1987 | Wright | 273/181 F |

FOREIGN PATENT DOCUMENTS

| | | | |
|---|---|---|---|
| 642980 | 9/1950 | United Kingdom | 273/29 A |

*Primary Examiner*—Richard C. Pinkham
*Assistant Examiner*—T. Brown

[57] ABSTRACT

A multi-purpose ball expelling apparatus which can be used with repeated operations for the training of baseball fielders, batters and pitchers comprising in combination a special netted frame in which a ball can be thrown, collected and pass into a special ball expelling machine which can be adjusted to expell the ball as a grounder, pop-fly or straight pitch. An inverted U-shaped frame is in a generally vertical plane and has a net stretched tightly across it. A brace is connected to each side leg of the U. A rectangular frame is supported in a generally horizontal plane by the U-shaped frame and braces. A second net is also stretched tightly across the rectangular frame. The rectangular frame downward somewhat toward its front edge to direct a ball into the expelling machine. A third net is attached to the top of the U-shaped frame and hangs loosely down to the net on the rectangular frame. This third net has a rectangular opening which serves as a baseball pitching target.

12 Claims, 6 Drawing Sheets

BALL CATCHING FRAME WITH BALL EXPELLING MACHINE CONNECTED THERETO

BACKGROUND OF THE INVENTION

1. Field of the Invention

This invention relates to a new type of multi-purpose ball expelling apparatus which can be used with repeated operations for the training of baseball fielders, batters and pitchers.

Specifically, the invention provides a new and highly effective portable multi-purpose ball expelling apparatus which can be used with repeated operations for the training of baseball fielders wherein the apparatus expells the baseball out to the players in the field in a variety of different types of balls, such as grounders, fly balls and straight pitches, and the fielder catches the ball and throws it back into the net of the said apparatus where it is again expelled out to the fielder and the process is repeated. In another embodiment, the new apparatus of the invention is used for the training of batters wherein the apparatus expells the baseball out to the batter near his strike zone, the batter hits the ball back into the net of the apparatus where it is again expelled out to the batter and the process is repeated. In a further embodiment, the apparatus of the invention is used for the training of pitchers wherein the apparatus throws the ball out to the pitcher who them pitches the ball back into the net of the apparatus aiming at the strike zone set out on the net of the apparatus, the ball is then recovered and expelled back to the pitcher and the process is repeated.

2. Prior Art

In the game of baseball, one of the most difficult skills to master is that of catching grounders or fly balls that have been hit out into the field. The fielder must learn to judge proper distance and to field the ball while in the proper postion.

In developing these skills, the trainer often has to throw the ball out into the field to simulate the fly ball or to have a batter hit the ball out to the fielder. This procedure becomes very tiresome and time consuming, and there is great need to develop a better way for the training of fielders.

In the game of baseball, another difficult skill to master is that of pitching. The pitcher must learn the various types of pitches, such as fast ball, sinkers, screw balls, etc. and to put such pitches within the strike zone of the batter.

In developing this skill, the pitcher works with a catcher who is behind home plate and catches the ball thrown by the pitcher and then return the ball to the pitcher so that he may try again. This procedure is also very tiresome and time consuming for the catcher, and there is a need to develop a better way for the training of pitchers.

Another difficult skill to be mastered in the game of baseball is that of batting. In this case, the coach or pitcher generally pitches the ball to the batter and takes a practice swing at the ball. This also is very tiresome and time consuming for the pitcher and there has been a great need for the improvement in the procedure for the training of batters.

Various pitch back machines have been developed in the past to help solve some of the above-noted problems, but they have all been deficient in some respects. For example, U.S. Pat. No. 4,517,953 discloses a pitch back machine for use in tennis practice. This machine is not suitable for use with hard baseballs. It is, for example, not capable or powerful enough to expell the balls for fielding practice. In addition, it is not capable of handling and returning balls which are as hard as the baseballs. Addition of baseballs causes considerable damage to the machine and apparatus. In addition, many of the machines have no speed or variable control over the expelling of the ball so variations in the pitch cannot be obtained.

U.S. Pat. Nos. 4,531,504, 4,197,827 and 3,724,437 disclose machines for pitching baseballs but these machines must be hand fed and are very complicated and difficult to adjust.

Furthermore, all such prior known machines are directed to the use of only a single training exercise, and none could be used as a multi-purpose machine for the training of all the skills, such as fielding, pitching and batting. As a result, each team must purchase a great variety of different machines at considerable cost to effect the proper training in all these areas.

It is an object of the invention, therefore, to provide a new and efficient multi-purpose ball expelling apparatus. It is a further object to provide a new type of ball expelling apparatus for the training of fielders. It is a further object to provide a new ball expelling apparatus for use in training fielders which eliminates the need for batters to hit the fielding ball. It is a further object to provide a ball expelling apparatus for training fielders which can be easily adjusted to give a variety of different types of pitched balls for catching by the fielder. It is a further object to provide a ball expelling apparatus that can be used with all types of hard balls without danger to the equipment. It is a further object to provide a new ball expelling apparatus that can be used for the training of pitchers. It is a further object to provide a ball expelling apparatus that can be used for training pitchers and does not require the use of a catcher to return the pitched balls. It is a further object to provide a new ball expelling apparatus that can be used for the training of batters and does not require the use of a pitcher to throw the ball to the batter. These and other objects will be apparent from the following detailed description thereof.

SUMMARY OF THE INVENTION

It has now been discovered that these and other objects can be accomplished by the new multi-purpose ball expelling apparatus of the present invention which presents for the first time and efficient and economical way for the training of fielders, pitchers and batters using only one type of apparatus.

The new ball expelling apparatus comprises in combination a special type of netted upright frame joined at an opening in the netted frame to a ball expelling machine. The new netted frame used in the combination comprises a first inverted U shaped frame having two separate legs as the side of the inverted U, each leg having a support brace one end of which is adjustably attached near the top of each leg and the other end of the brace resting on the ground so as to maintain the inverted U shaped frame in a forwardly inclined position, a different rectangular frame having two sides, a back and front sections, the front end of the two opposite sides of said rectangular frame being adjustably joined between and to the said support braces from about 10 to 25 inches above the bottom of the said braces, and the back end of said opposite sides being adjustably joined between and to the legs of the inverted U shaped frame at a position so as to have the rectangular frame sloping downward and said back ends of the opposite sides extending beyond the legs and joining the back end of the rectangular frame so as to form a reinforcement section to said frame, the front section of the rectangular frame being formed in a V shape manner and being fixedly attached to and within the braces at about 10 to 25 inches from the bottom of said braces, and having means for attaching a ball expelling machine at the point of the V, a tight net being joined to all sides of the rectangular frame with an opening near the point of the V at the front of said frame to permit any ball on the net to drop down the opening, a tight net being attached between the legs of the inverted U shape frame, and a net being attached to the top of the inverted U shaped frame and loosely hanging down so that the bottom end touches the net on the rectangular frame.

The ball expelling machine that is firmly attached to the front section of the rectangular frame at the point of the V comprises a housing with an opening at the top into the machine positioned directly under the opening in the net at the point of the V on the front section of the rectangular frame, a power driven wheel in said housing positioned such that the outer circumference edge of the wheel strikes the outside cover of any ball dropping down the opening and forcefully pushes it forward along the inside of the housing, a curved ledge following the contour of the wheel but under the wheel and positioned so as to direct any pushed ball into an outward direction towards an opening in the front side of the housing, an adjustable lever at the end of the curved ledge that can be adjusted to change the slope of the ball as it exits the opening in the housing.

The above-noted assembled apparatus can surprisingly be used with great success for training of young ball players in almost all phases of the baseball training. The apparatus is particularly suited, for example, for the training of fielders/. In this case, the fielder throws the baseball against the loose netting hanging down from the top of the inverted U frame, the movement of the ball is then impeded and the ball drops down onto the tight netting of the rectangular frame and rolls into the opening at the point of the V at the front of the rectangular frame. The ball then drops down into the opening of the ball expelling machine and is again rapidly forced out of the opening at the front of the ball expelling machine. By adjusting the lever in the machine as shown in FIG. 7, the ball can be expelled as a grounder, pop fly or straight hit ball. The fielder then retrieves the ball and throws it back into the net of the frame and the process is repeated.

Another preferred embodiment of the invention is the use of the new apparatus for the training of pitchers. In this case, strips of canvas are attached to the loose netting hanging from the inverted U frame and placed at a location on the netting of a typical strike zone as shown in FIG. 2. A pitcher then remains in front of the frame at the correct distance and attempts to throw the ball into the strike zone on the netting. When the ball hits in the strike zone attached to the netting, the movement of the ball is impeded and the ball falls down onto the tight netting of the rectangular frame and rolls into the opening in the net and into the expelling machine. The ball is then thrown out to the pitcher and he again attempts to pitch the ball into the strike zone. This is a great improvement in training of pitchers as it permits the pitcher to work by himself without the need of a catcher to return the ball and this greatly speeds the training of the pitcher.

Another preferred embodiment is the use of the new apparatus for the training of batters. In this case, the lever on the ball expelling machine is set for the straight pitch, and the ball thrown against the netting where it rolls down into the opening of the ball expelling machine. The machine being set for a straight pitch then expells the ball as a pitched ball to the batter standing in front of the apparatus. The batter then attempts to hit the pitched ball either directly back into the netting of the machine or past the machine. If the ball is hit back into the netting, the ball rolls down the netting into the opening in the ball expelling machine and is again sent out for the batter to attempt to hit the pitched ball. This is a significant improvement in the training of batters as it eliminates the need of a pitcher as well as a catcher in the training process, and the batting training can be accomplished faster and more efficiently than possible heretofore.

DESCRIPTION OF THE DRAWINGS

The various objects and features of the present invention will be more fully understood by reference to the accompanying drawings.

Referring now to FIG. 1, the inverted U frame is shown as 11, 11A and 12. This frame may be all in one piece or in three sections as shown in this Figure. Braces 13 and 13A are shown adjustably attached to the legs of the inverted U at 28 and 28A. The braces may be in two pieces telescopically joined within each other as shown as 30 or may be just one piece. The placing of the braces as two pieces makes it much easier on the disassembly of the apparatus.

In FIG. 1, the rectangular frame is shown attached within and to the legs and braces. The front section 39 is welded to the braces at 35. The back reinforcing U-shaped frame 26 is also welded to the legs of the inverted U frame at 34. The sides 14 and 14A of the rectangular frame are adjustable attached to the braces at 36 by bolt means, and to the legs of the upright inverted U frame by latch means 29. The front section of the rectangular frame is in the form of a V with plate 30 for attaching the ball expelling machine in the center point of the V as 30. As noted, the extension of the rectangular frame beyond the upright legs is necessary to give the increased strength for the throwing of baseballs against the net. This extension is shown as 26. The netting stretched between the sides of the rectangular frame is shown as 18, with the opening at the front section as 19. The netting is tightly held towards the back section by means of webbing 25 and against the other sides of the frame by snaps 27.

Figure 2:
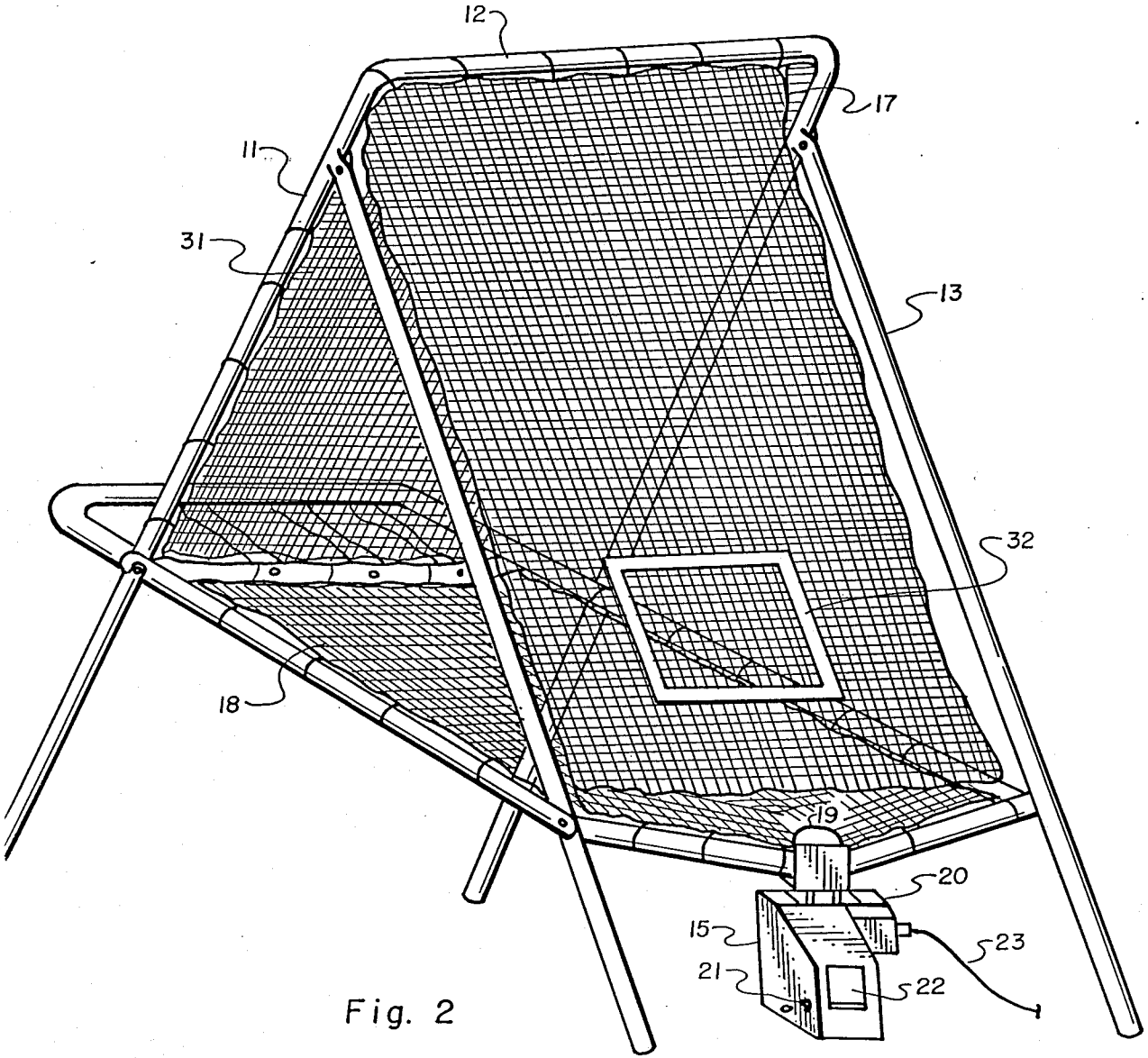
FIG. 2 is a perspective view of the total frame containing netting on the bottom, front and back sections of the frame with the front section of the rectangular frame attached to the ball expelling machine.

The same frame is shown in FIG. 2 with the exception that the netting attached to the legs of the inverted U frame is shown as 31, and the netting hanging loose from the top of the same inverted U frame is shown as 17. The strips of canvas showing the outline of the strike zone attached to the hanging net is shown as 32. The opening in the net where the ball drops into the machine is shown as 19. The ball expelling machine is shown as 15 with the covered housing for the motor shown as 20, the preferred electrical power source as 23, the opening for the balls to exit as 22 and the adjustable lever regulated openings as 21.

Figure 3:
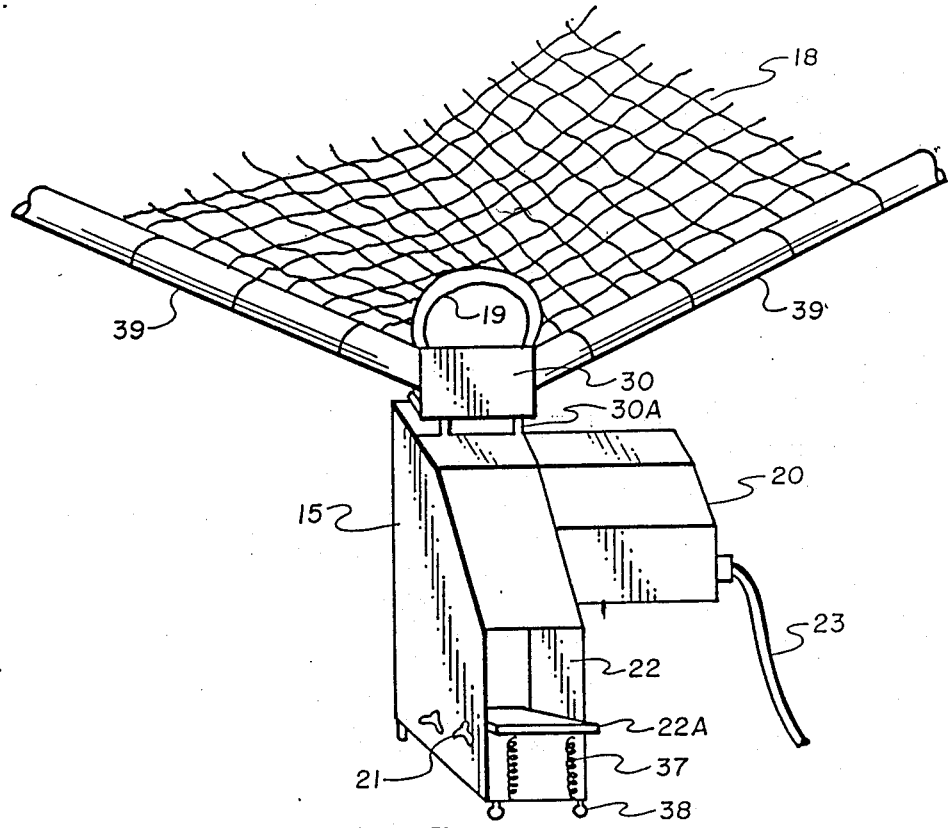
FIG. 3 is a front view of the ball expelling machine illustrating its attachment to the frame and the source of the power.

FIG. 3 is a front view of the ball expelling machine 15 attached to the frame 39. The plate welded to the center of the V shaped frame 39 is shown as 30, with the bolt means attached to said plate as 30A. The housing for the motor is shown as 20, the electric power source as 23, the opening for the exit of the ball as 22, the adjustable lever as 22A, the spring to hold the lever in place as 37, the openings for the adjustment of the lever as 21, and the adjustable support for the housing as 38.

Figure 4:
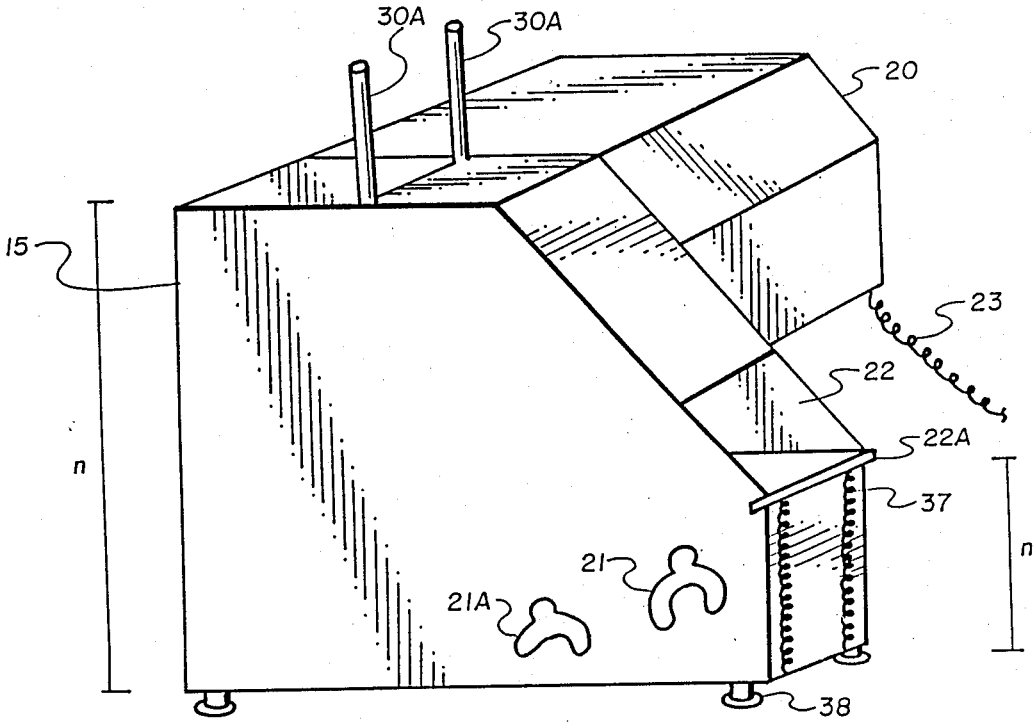
FIG. 4 is a side view of the ball expelling machine.

FIG. 4 is a side view of the ball expelling machine 15 with the bolt means for attachment to the frame as 30A, the cover for the motor as 20, the power source as 23, the opening for the exit of the ball as 22, the adjustable lever 22A, spring 37, openings for the adjustable lever control as 21 and 2A, and the leveling adjustment for the housing as 38. Line n is the cut away portion discussed under FIG. 6.

Figure 5:
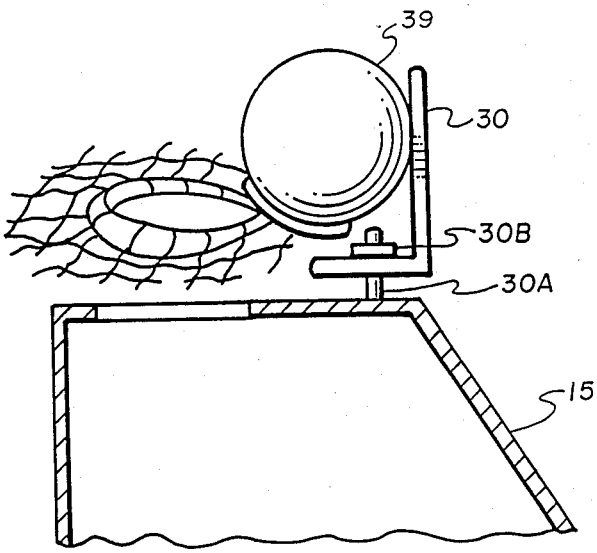
FIG. 5 is a partial side view showing the attachment of the ball expelling machine to the frame.

FIG. 5 is a cut away portion illustrating how the ball expelling machine 15 is firmly attached to the frame to insure that the expelling of the ball occurs in the proper way. The frame is shown as 39, the plate welded to the frame as 30, bolt means to secure the machine to the frame as 30A with locking means nut 30B, and the opening in the net as 19.

Figure 5A:
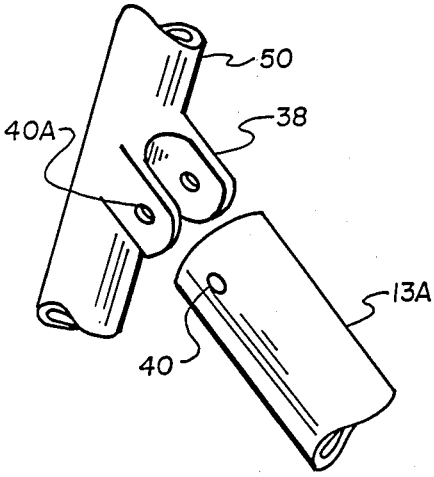
FIG. 5*a* is a cut away portion of a section of the top of a brace illustrating how it can be adjustably attached to the upright leg of the inverted U frame.

FIG. 5*a* illustrates the method of adjustably attaching the braces to the legs of the inverted U frame. The brace is shown as 13A, the U shaped female latch as 38 welded to frame 50, with the opening for the bolt means as 40 and 40A.

Figure 5B:
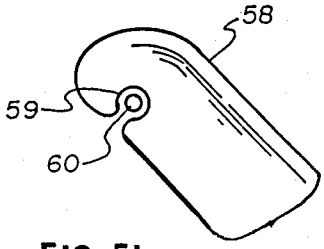
FIG. 5*b* is another cut away portion of an end portion of a side of the rectangular frame illustrating how it can be removably attached to the upright leg of the inverted U frame.

FIG. 5*b* illustrates the method of adjustably attaching both sides of the rectangular frame to the legs of the inverted U frame. The side is shown as 58, the latch cut out as 59 with the peg means to hold the latch as 59.

Figure 6:
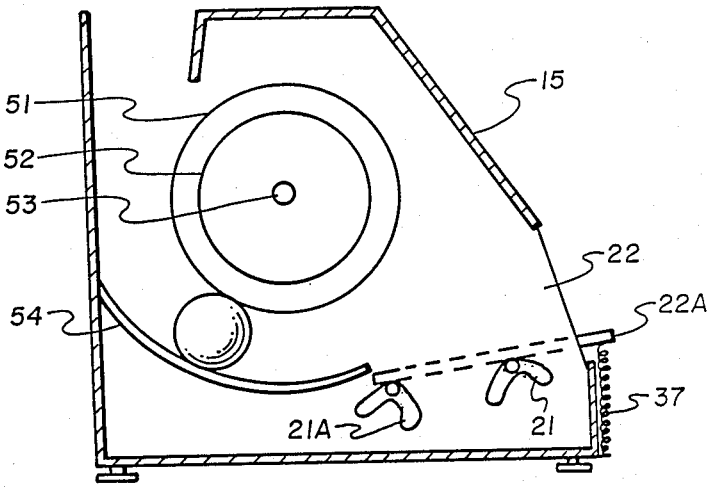
FIG. 6 is a cut away view along line n in FIG. 4 showing the operations of the ball expelling machine.

FIG. 6 is a cut away view of the ball expelling machine along line n in FIG. 4. The wheel is shown as 52 on shaft 53. The outer layer of rubber is shown as 51. The curved ledge to guide the ball upward and out the exit is shown as 54, with the adjustable lever as 22A, with tie down springs 37 and the opening for the adjustable lever rods as 21 and 21A.

Figure 7:
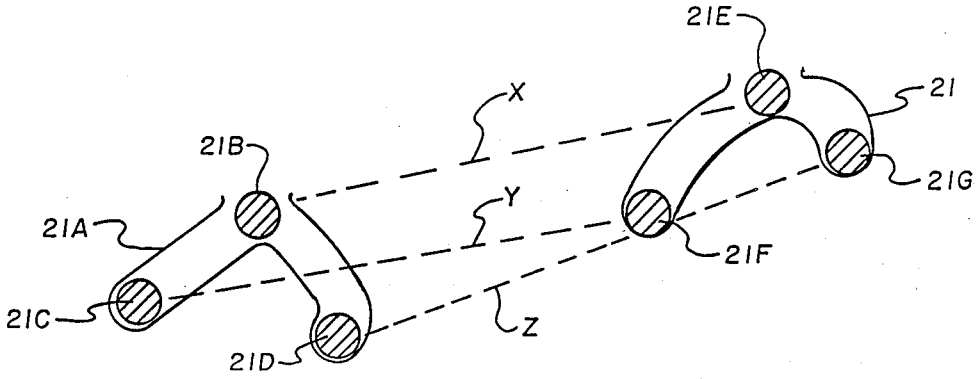
FIG. 7 is a diagram showing the various positions the adjustable lever can be placed to give the right type of pitch to the ball as it is expelled out.

FIG. 7 illustrates the various positions of the adjustable leever placed in the openings on the side of the housing to obtain the desired type of pitched ball. The front openings in the side of the housing for the lever rods are shown as 21 and 21A. To obtain a pop fly, the position of the rods on the adjustable lever are shown on line Z with the rods at 21D and 21G. For a grounder, the position of the rods on the adjustable lever are shown on line Y with the rods at 21C and 21F. For a srraight pitched ball, the position of the rods are shown on line X with the rods at 21B and 21E.

Figure 7A:
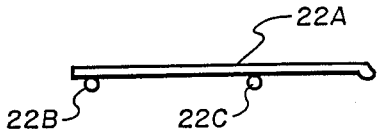

FIG. 7*a* is a side view of the adjustable lever 22 with the rods welded to the bottom of the lever as 22B and 22C.

Figure 8:
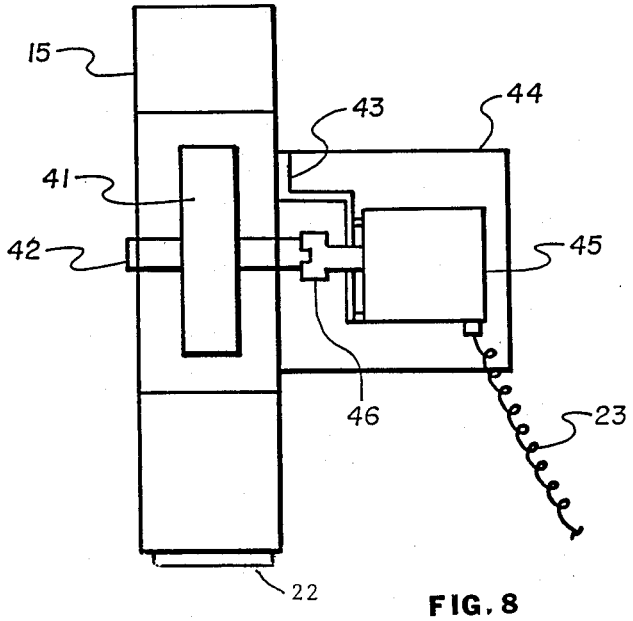
FIG. 8 is a cut away top view of the ball expelling machine showing how the wheel functions to expel the ball.

FIG. 8 is a cut away top view of the ball expelling machine 15. The wheel is shown as 41, the shaft as 42, the coupling attached to the motor shaft as 46, the brace to hold the motor as 43, the motor housing as 44, the motor as 45 and the electrical cord supplying the power as 23. The lip of the adjustable lever extending out of the exit opening is shown as 22.

DETAILED DESCRIPTION OF THE INVENTION

While the above-described description of the invention and drawings have been made in rather specific terms, it should be understood that various changes can be made in construction and operation without departing from the scope of the present invention.

The inverted U frame, the braces attached thereto and the rectangular frame can be prepared from any suitable framing material. The framing can be round, square or any dimension as long as it provides the necessary function as noted above. In general, the framing is best prepared from tubular material, such as metal piping, plastic tubing and the like. The diameter of of the tubular material may vary, but is preferably between about 1 to 1½ inches, although smaller or larger sizes can be employed.

The dimensions, i.e. the height and width of the sections of the frame, can vary as desired or necessary to accomplish the desired purpose. For example, the frame can be in the shape of a square, rectangular or other shape as needed. In general, the inverted U frame is in the form of an open rectangle which may have a height of about 5.5 to 8 feet, and preferably 6 feet, and a width at the top of about 3 to 6 feet, and preferably 5 feet 8 inches.

The braces used to support the inverted U frame in an upright position should be of sufficient length to have the inverted U frame sloping forward at the desired angle. In general, the inverted U frame should preferably slope forward at an angle varying from about 50 to 70 degrees measured at ground level. Still more preferably the braces maintain the inverted U frame so that the angle at the ground is about 60 degrees.

As shown in the drawings, the braces are attached near the top of each of the legs of the inverted U frame and then slope downward to maintain the frame at the proper angle. The braces are preferably movably attached to the frame so that on disassembly the braces can be folded back against the inverted U frame. This can be accomplished by the use of the U shaped lach means attached to the sides of the frame as shown in FIG. 5*a*. The braces can also be removed from the frame by merely removing the bolt means used to join the braces to the frame legs.

The rectangular frame can also vary in size and shape as desired and necessary. As shown in the drawings, the rectangular frame preferably fits inside the inverted U frame and the braces so the width of the frame should be so adjusted. Less preferred method is to have the frame on the outside of the inverted U frame as the operation becomes less efficient with that construction.

Figure 1:
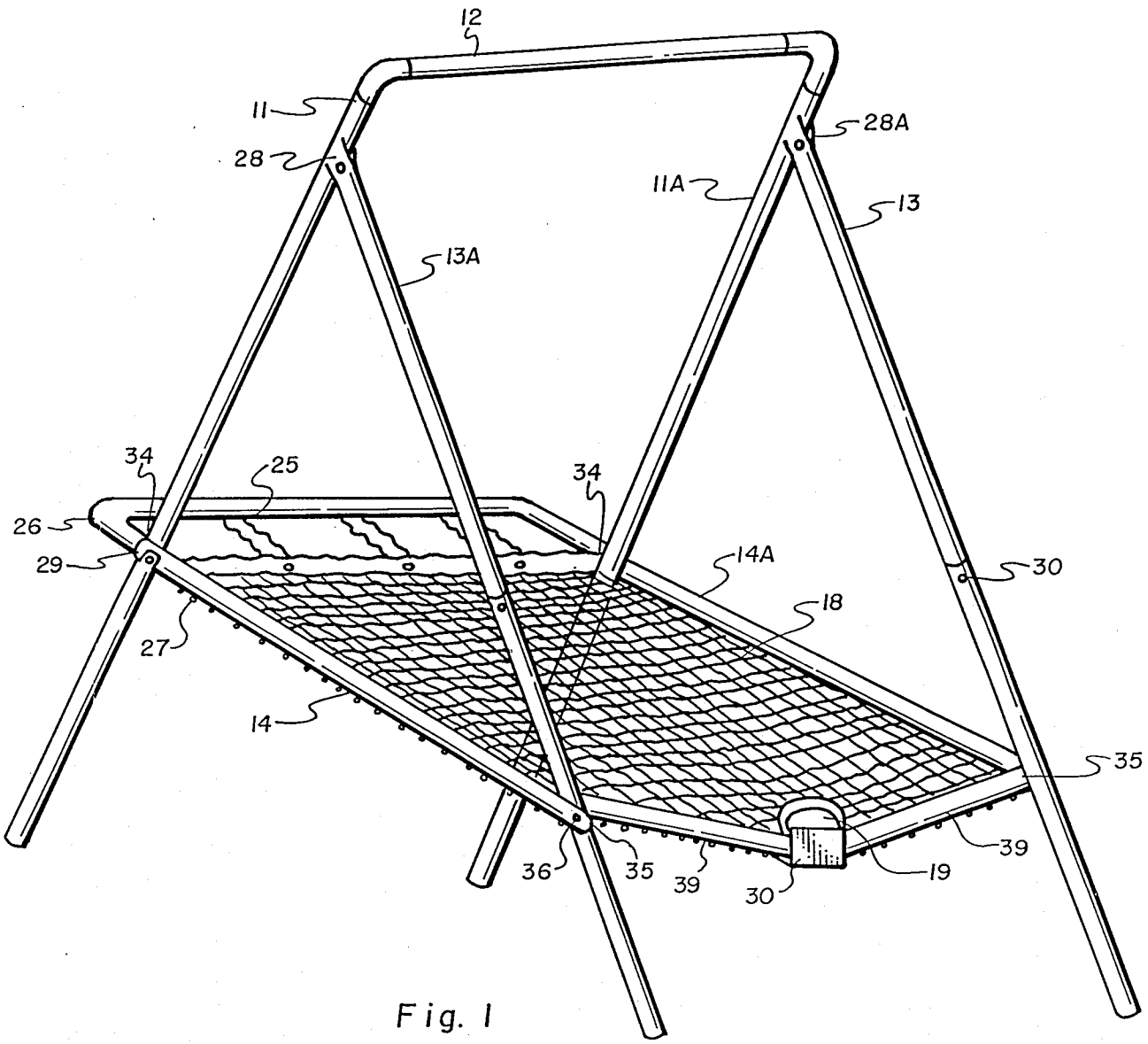
FIG. 1 is a perspective view of the total frame construction containing netting on the rectangular frame section.

As noted, the rectangular frame is made up of 2 opposite sides, a front section and a back section. The dimensions of these parts can vary as desired. As noted also it is important to have a reinforcing U frame which extends beyond the legs of the inverted U frame so as to give the total structure the necessary stability when used for baseball training. In order to accomplish this reinforcement to prevent damage by the baseballs, the opposite sides of the rectangular frame are extended beyond the legs of the inverted U frame and the joined to the back ed of the same frame as shown in FIG. 1. The extended reinforcing U frame is preferably extended beyond the inverted U frame legs from about 10 inches to about 1½ feet, and and has a width equal to the width between the inverted U frame legs.

As noted above, the front section of the rectangular frame is formed into a V so as to provide a slope for the balls to rapidly roll down into the opening at the point of the V. The slope of the V can vary as long as it provides enough incline for the balls to roll into the opening at the point of the V. In most cases, a slope of from 10 to 20 degrees is sufficient to obtain the desired roll of the ball. The point of the V is from 10 to 25 inches, and preferably 15 to 25 inches from the ground.

A metal L shaped plate possessing openings for the bolt means from the ball expelling machine is welded onto the front of the V shaped front section. At least two holes in the said plate are necessary to keep the machine in a straight line and firmly attached to the frame.

The sides of the rectangular frame can be firmly attached to the lefts of the inverted U frame and braces or they can be removably attached as shown in FIG. 5*b* to assist in the disassemblying of the apparatus. In this case, one end of the side frame is joined by bolt means to the front brace and the other end is removably attached to the inverted U frame leg by means of a latch that fits over a peg on the leg.

The netting to be stretched across the frames and hung loosely from the top of the inverted U frame can be of any suitable type as long as it provides support for the stopping and controlling the path of the baseballs. The netting as such can vary in weight (denier) as well as the type and size of filament. In general, the netting is preferably made of nylon filaments of about 10 to 18 mils and has openings varying from about 1 to 2 inch squares.

The netting may be attached to the frame in any suitable manner. The netting can be held by cords tied around the frame or by snaps or by being sown onto canvas sleeves which can be slipped over the frame pieces. As shown in FIG. 1, nylon webbing can sometimes be used to hold the netting against the frame.

The ball expelling machine can be constructed in a variety of ways as long as it brings about the desired pitch of the baseball. The wheel to be used as the impelling force is preferably of small size, and generally varies from about 4.5 to 6 inches in diameter. The wheel can be made of any suitable material, such as iron, plastic, and the like, but preferably has a layer of rubber or polyurethane of about ¼ to ½ inches in thickness on the outside circumference of the wheel.

The power used to operate the wheel may vary but is preferably derived from an electric motor, and preferably a variable speed motor of about 1/5 to 2 horsepower to obtain at least 10,000 rpm.

The lever used to adjust the pitch of the ball as it exits the housing should be constructed as shown in FIG. 7*a*. The lever plate is preferably prepared from about ¼ inch sheet metal with the 1/5 to 12 inch rods welded underneath at the front and back of the said lever. The rods extend out from the sides of the lever so that they may be inserted into the adjustment holes in the side of the housing as shown in FIGS. 6 and 7. Two springs attached to the outside edge of the lever snaps the lever in place after it has been moved to the proper adjustment location. The manner of adjusting the lever to obtain the desired types of pitched balls is shown in FIG. 7. By adjusting the lever as shown in that Figure, the expelled ball can be made into a pitched grounder wherein the rods are in position c12C and 21F, or the ball can be made into a pop fly by having the rods in position 21D and 21G, or the ball can be a straight pitch by having the rods in positions 21B and 21E.

SPECIFIC EMBODIMENT OF THE INVENTION

A specific embodiment of the new multipurpose ball expelling apparatus of the present invention and illustration of its use are illustrated below.

An inverted U frame was prepared from 1¼ inch metal pipe. Each leg was approximately 6 ft long and the top of the U frame was about 5 ft 8 inches in length. Support braces about 6 ft long were prepared from the same plastic tubing and adjustably attached to each of the legs of the inverted U frame approximately 6 inches from the top of the frame. 2 inch bolts were used to attach the braces to the frame. A rectangular frame was then attached to the inside of the inverted U frame and the leg braces as shown in FIG. 1. The front section of the rectangular frame was in a V shape with the slope approximately 20 degrees from the center point of the V. The center point of the V was approximately 15 inches from the ground. The sides of the rectangular frame were adjustably connected to the legs of the inverted U frame as shown in the drawings so that the frame could be easily dissassembled and fold up when not in use. A U shaped tubular frame of about 1 ft by 5.5 ft dimension was joined to the legs so as form the reinforcement frame as shown in FIG. 1 to add support to the frame when baseballs are thrown back into the net on the frame.

Nylon neting prepared from 18 mil filaments with spacings of about ½ inch was stretched over the rectangular frame and the back of the inverted U frame as shown in FIG. 1. The netting was held on the frame by binding with nylon rope. A loose netting was bound on the top of the inverted U frame and allowed to hang loose down to the netting on the frame.

A ball expelling machine was prepared by forming a housing of sheet metal as shown in FIG. 4. The openings for the balls at the top of the housing was about 4×4 inches. The housing of the ball expelling machine was attached to the bottom section of the rectangular frame at the point of the V by means of two bolts welded to the top of the housing and inserted into two openings on an L shaped metal ledge welded to the frame.

The wheel inside the housing was a cast iron wheel of about 4 inches in diameter and 1¼ inches in thickness. A ½ inch layer of hard rubber was attached to the outside circumference of the wheel. The wheel was turned by direct drive from a 1/5 horespower 10,000 rpm electric motor using ⅜ inch shaft. A metal ledge under the wheel followed the contour of the wheel and was the baseball distance from the said wheel. The front end of the ledge terminated over the top of a movable lever which could be raised or lowered to provide different types of pitched balls as shown in FIG. 7. Rods attached to the bottom of the front and back of the lever fitted into the openings on the outside of the housing as shown in FIG. 6. The lever was held tightly in place by the springs on the outside of the housing.

the ball expelling machine was then attached to the frame as described above and put into operation for training of fielders. The fielder threw the baseball against the loose netting which then bends back against the netting on the inverted U frame and the ball then drops down onto the tight netting of the rectangular frame and rolls into the opening at the point of the V at the front of the rectangular frame. The ball then drops down into the opening of the ball expelling machine and is rapidly forced out of the opening at the front of the ball expelling machine. By adjusting the lever in the machine as shown in FIG. 7, the expelled ball can be made into a grounder, pop fly or straight pitch. The fielder then gets experience in retrieving the ball and throws it back into the net of the apparatus and the process is repeated.

For the training of a pitcher, 2 inch strips of canvas are attached to the loose netting hanging down from the invert U frame and placed at the location of a typical strike zone as shown in FIG. 2. A pitcher then stands in front of the apparatus at the correct pitching distance and attempts to pitch the ball into the strike zone area. When the ball hits the strike zone on the net, the ball forces the loose netting against the back netting and the ball falls down onto the netting on the rectangular frame and rolls into the opening at the front of the apparatus and then into the ball expelling machine. The ball is then expelled out to the pitcher and he again attempts to pich the ball into the strike zone.

For the training of a batter, the lever on the ball expelling machine is set for the straight pitch, and the ball placed on the net where it rolls down into the ball expelling machine and is pitched out as a straight pitch. The batter in front of the machine then attempts to hit the ball either back into the the netting or to the side or over the netting. If the ball is hit into the netting, the ball will again go into the ball expelling machine and expelled out for the batter to make another attempt at hitting the ball.

I claim as my invention:

1. A multi-purpose ball expelling apparatus that can be used with repeated operations for the training of baseball fielders, batters and pitchers comprising in combination a netted frame joined to a ball expelling machine, (a) the said netted frame comprising an inverted U shaped frame having two separate legs as the sides of the inverted U, each leg having a support brace one end of which is adjustably attached near the top of each leg and the other end of the brace resting on the ground so as to maintain the inverted U shaped frame in a forwardly inclined position, a rectangular frame having two sides, a back and front section, the front end of the two opposite sides of said rectangular frame being adjustably joined between and to the said support braces from about 10 to 25 inches above the bottom of said braces, and the back end of said opposite sides being adjustably joined between and to the legs of the inverted U shaped frame at a position so as to have the rectangular frame sloping downward and said back ends of the opposite sides extending beyond the legs and joining the back end of the rectangular frame so as to form a reinforcement section to said frame, and the front section of the rectangular frame being formed in a V shape and being fixedly attached to and within the braces at about 10 to 25 inches from the bottom of said braces, and having means for attaching a ball expelling machine at the point of the V, a tight net being joined to all sides of the rectangular frame with an opening near the point of the V at the front of said frame to permit any ball on the net to drop down the opening, a tight net being attached between the legs of the inverted U shaped frame, and a net being attached to the top of the inverted U shaped frame and loosely hanging down so that the bottom end touches the net on the rectangular frame, (b) a ball expelling machine being firmly attached to and under the front end of the rectangular frame at the point of the V, said machine comprising a housing with an opening at the top positioned directly under the opening in the net at the point of the V on the front section of the rectangular frame, a power driven wheel in said housing positioned such that the outer circumference edge of the wheel strikes the outside cover of any ball dropping down the opening and forcefully pushes it forward along the inside of the housing, a curved ledge following the contour of the wheel but under the wheel and positioned so as to direct any pushed ball into an outward direction towards an opening in the front side of the housing, an adjustable lever at the end of the curved ledge that can be adjusted to change the slope of the ball as it exits the opening in the housing.

2. A ball expelling apparatus as in claim 1 wherein the rectangular frame slopes downward forming an angle with the ground of between 30 and 45 degrees.

3. A ball expelling apparatus as in claim 1 wherein the front section of the rectangular frame forms a V shape such that the sides slope to form an angle between 10 to 25 degrees.

4. A ball expelling apparatus as in claim 1 wherein the netting is prepared from filaments of 10 to 18 mils and has net openings of about ¼ to ¾ inch squares.

5. A ball expelling apparatus as in claim 1 wherein the net hanging loose from the top of the inverted U frame has a strike zone marked on said netting.

6. A ball expelling apparatus as in claim 1 wherein the rectangular frame has a reinforced U shaped frame extending beyond the legs of the inverted U frame to give added strength to the frame.

7. A ball expelling apparatus as in claim 1 wherein the frames are made from tubular material having a diameter of from 1 to 2 inches.

8. A ball expelling apparatus as in claim 1 wherein the power means in the ball expelling machine has speed control so as to vary the speed of the wheel.

9. A ball expelling apparatus as in claim 1 wherein the adjustable lever at the end of the curved ledge in the machine housing can be adjusted by changing the slope of the lever and thus determining the ejected ball to be a grounder, a pop fly or a straight pitch.

10. A ball expelling apparatus as in claim 1 wherein the wheel in the housing of the ball expelling machine has an outer layer of rubber or plastic on the circumference edge.

11. A ball expelling apparatus as in claim 1 wherein the wheel has a diameter of about 4 to 5 inches and a thickness of about 1 to 1¼ inches.

12. A netted frame for use in conjunction with a ball expelling machine comprising an inverted U shaped frame having two separate legs as the sides of the inverted U, each leg having a support brace one end of which is adjustable attached near the top of each leg and the other end of the brace resting on the ground so as to maintain the inverted U shaped frame in a forwardly inclined position, a rectangular frame having two sides, a back and front section, the front end of the two opposite sides of said rectangular frame being adjustably joined between and to the said support braces from about 10 to 25 inches above the bottom of said braces, and the back end of said opposite sides being adjustably joined between and to the legs of the inverted U shaped frame at a position so as to have the rectangular frame sloping downward, the back section of the rectangular frame being fixedly attached to and inside the legs of the inverted U frame, and the front section of the rectangular frame being formed in a V shape and being fixedly attached to and within the braces at about 10 to 25 inches from the bottom of said braces, and having means for attaching a ball expelling machine at the point of the V, a tight net being joined to all sides of the rectangular frame with an opening near the point of the V at the front of said frame to permit any ball on thenet to drop down the opening, a tight net being attached between the legs of the inverted U shaped frame, and a net being attached to the top of the inverted U shaped frame and loosely hanging down so that the bottom end touches the net on the rectangular frame.

* * * * *